United States Patent [19]

Feaster

[11] 4,308,487

[45] Dec. 29, 1981

[54] DUAL INTERNAL ELECTRIC SPARK PLUG

[76] Inventor: James L. Feaster, 21724 SE. Alder Dr., Apt. 1, Gresham, Oreg. 97030

[21] Appl. No.: 116,798

[22] Filed: Jan. 30, 1980

[51] Int. Cl.[3] ..... H01J 7/44; H01J 17/34; H01J 19/78; H01K 1/62

[52] U.S. Cl. ..... 315/58; 313/136; 313/140; 315/57; 315/71

[58] Field of Search ..... 313/128, 136, 140, 131 A; 315/58, 57, 59, 62, 71

[56] References Cited

U.S. PATENT DOCUMENTS

| | | | |
|---|---|---|---|
| 1,033,449 | 7/1912 | Murray | 313/128 |
| 1,191,429 | 7/1916 | Jensen | 315/58 |
| 1,363,904 | 12/1920 | Nicholson | 313/128 |
| 3,956,664 | 5/1976 | Rado et al. | 315/58 |
| 4,144,474 | 3/1979 | Nishio et al. | 315/58 |

*Primary Examiner*—Saxfield Chatmon, Jr.

[57] ABSTRACT

A spark plug for an internal combustion engine; the plug including a pair of electrodes spaced alongside each other, and extending through an insulator fitted in a metal casing that is threaded, so as to be screwed into the engine, each electrode being intercepted by a solid state H.V. time delay device, which, in one example thereof, may comprise a high voltage diode, and, in another example, may comprise a solid state semi-conductor or the like.

4 Claims, 11 Drawing Figures

DUAL INTERNAL ELECTRIC SPARK PLUG

This invention relates generally to ignition devices, and more particularly, to internal combustion engine spark plugs. Still more particularly, it relates to spark plugs of dual ignition gap type.

Dual gap spark plugs have been known in the art. These plugs, however, were of simple design, providing elementary gaps for simultaneous non-independent ignition. In this way, they provided greater reliability, in that, should one gap "foul", the other would provide ignition for continued combustion within the cylinder, although at some reduction in efficiency.

It is a principal object of the present invention to provide a spark plug for fitting in a single spark plug opening of an engine cylinder, but which is characterized by having a plurality of electrodes, instead of only one, thus providing a means of delivering two high voltage sparks independently of each other, for igniting the compressed fuel and air mixture within the engine cylinder; and each of the electrodes being intercepted by a solid state H.V. time delay device, for delaying a spark ignition.

Another object is to provide a spark plug of the type described, which may utilize one high voltage ignition system, for producing a spark at both gaps of the plug, or it may be adapted for use with a dual high voltage ignition system.

Yet another object is to provide an improved dual internal electric spark plug, in which each of the time delay devices may be out of synchronization from each other, and may be timed for different intervals.

Still another object is to provide an improved dual internal electric spark plug, which is fired from two different ignition systems, and wherein they are out of synchronization, so that a firing from each is controlled in selective delay intervals.

Still another further object is to provide a spark plug of the type described, which will substantially increase volumetric efficiency of an internal combustion engine, while simultaneously decreasing air pollution from the engine exhaust.

Other objects are to provide an improved dual internal electric spark plug, which is simple in design, inexpensive to manufacture, rugged in construction, easy to use and efficient in operation.

These, and other objects, will be readily evident, upon a study of the following specification, and the accompanying drawings, wherein.

Figure 1:
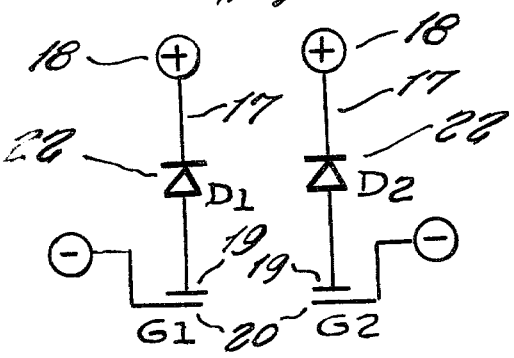
FIG. 1 is an electrical diagram showing one design of diode combination in an electrical circuit of a dual spark plug, each electrode of the spark plug being intercepted by a time delay device comprised by the diodes.
Figure 2:
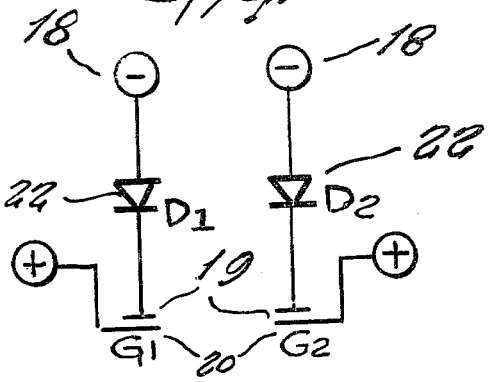
FIGS. 2 through 6 are each an electrical diagram of different diode combinations in an electrical circuit of a dual spark plug, each electrode of the spark plug being intercepted by a time delay device comprised of the particular arrangement of the diodes.
Figure 3:
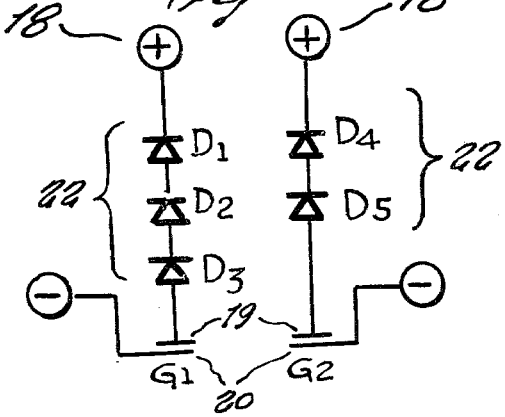
Figure 4:
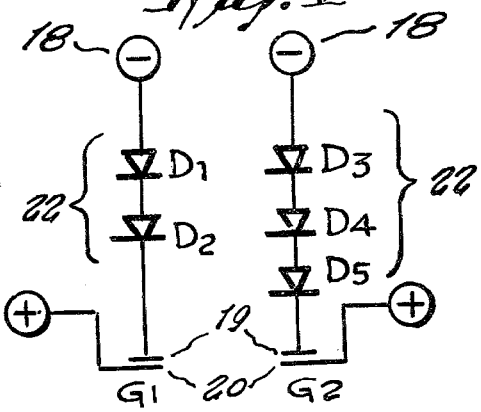
Figure 5:
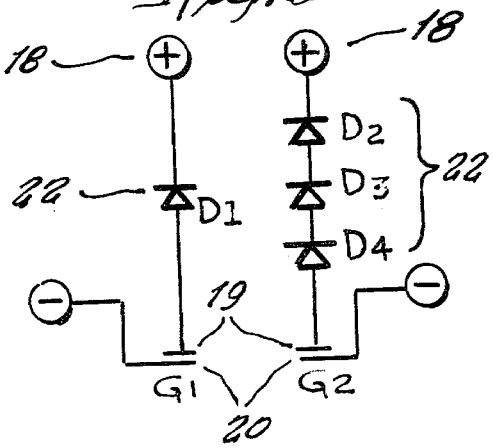
Figure 6:
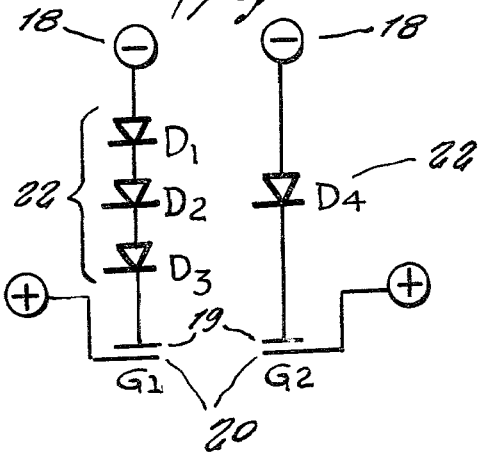
Figure 7:
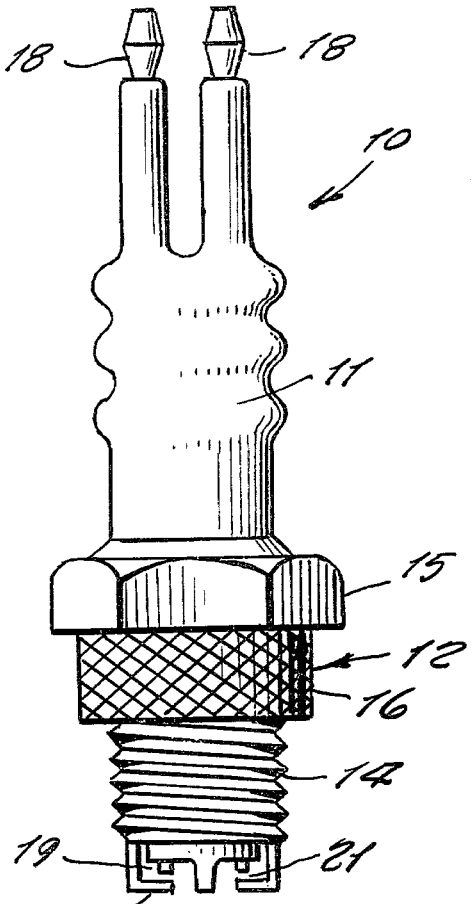
FIG. 7 is a side elevation view of a spark plug incorporating the present invention.
Figure 8:
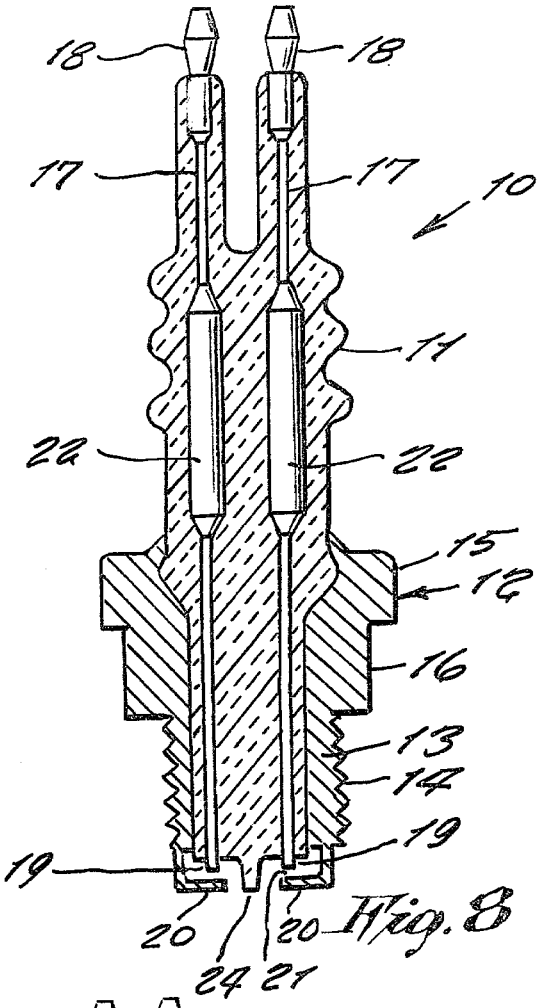
FIG. 8 is a cross-sectional view thereof on a longitudinal axis, and on the same plane as FIG. 7.
Figure 9:
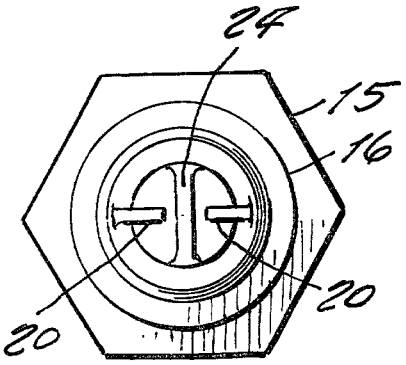
FIG. 9 is a bottom view thereof.

Referring now to the drawings in greater detail, and more particularly, to FIGS. 1, 7, 8 and 9 at this time, the reference numeral 10 represents an improved dual internal electric spark plug, according to the present invention, wherein there is provided an insulator 11, which may be molded of ceramic material, and which is made inside a steel casing 12, having a barrel portion 13 at one end thereof, made with an external screw thread 14, for screwing into an engine cylinder head. An opposite end 15 of the casing is hexagonal in shape, so as to be turned by a wrench. An intermediate portion 16 may be knurlled for turning by a hand.

Two electrodes 17, in parallel, spaced-apart relation to each other, extend through the insulator. The upper protruding ends 18 thereof are shaped for electric wire connectors to snap-fit therearound, while the lower protruding ends comprise positive contacts 19, spaced from L-shaped anvils formed on the end of the casing barrel, so as to comprise negative contacts 20. A space between each pair of contacts 19 and 20 comprises a gap 21, across which a spark can jump.

A different number of such diodes may be provided in the delay device of each of the electrodes, so that each electrode is differently delayed in firing a spark.

Alternately, it may comprise a solid state semiconductor. While it is neither a resistor nor a conductor, it does have the characteristics of both of them together.

A protruding barrier 24, on an end of the insulator, extends between the sets of contacts, so as to prevent any possibility of a spark from one set effecting the other set.

It is to be noted, as shown in FIGS. 1 through 6, that various combinations of diodes may be used in the electrical circuit of the delay devices 22. The various combinations that are possible to make are not limited to the examples illustrated, but may comprise others not shown, as well. It is through the various combinations that the delay in the ignition is achieved. Heat and high voltage can both be tolerated on the manufacture of a diode for this purpose, and it is also not affected by vibration. The individual external ignition system (or systems) is protected from flash back, the inter-electrode shield at the tip of the plug not being required, although it would aid in confining the ignition spark to its respective anvil.

An important feature of the present invention is that the two closely-times ignition sparks will increase the efficiency of the burn, over that of two simultaneous ignition sparks for the same volume of fuel mixture.

FIGS. 1 through 6 show that the terminals to the distributor, and/or ignition system (or systems) may be made either positive (+) or negative (−).

All diodes are of high voltage type, with special physical and electrical design considerations for insertion into the respective cavities provided for the insulator at the time of manufacture.

A fixed pre-determined high voltage time delay can thus be achieved. The unidirectional diode design, shown in FIGS. 1 through 6, prevents flash back across the electrodes. A lean burn, for greater combustion efficiency, is attained.

Figure 10:
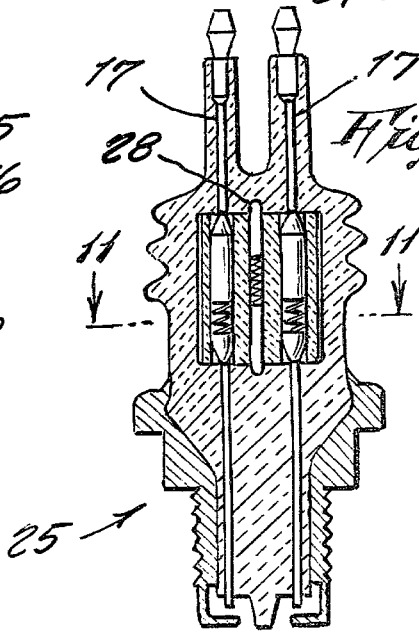
FIG. 10 is a cross-sectional view similar to FIG. 8, and showing a modified construction thereof, wherein the delay devices of the electrodes may be selectively varied.
Figure 11:
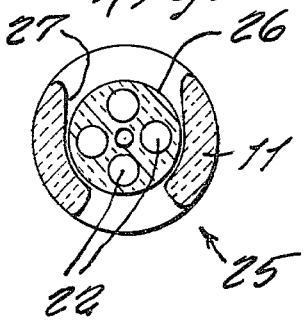
FIG. 11 is a transverse cross-sectional view, taken on line 11—11 of FIG. 10.

Referring now to FIGS. 10 and 11, a modified design of improved dual internal electric spark plug 25, is the same as plug 10, except that it additionally includes the feature of the delay device for each electrode being selectively adjustable. Thus, as shown, four solid state H.V. time delay devices 22, of different delay values, are carried in a rotatable barrel 26, made of insulator material, and which is rotatably mounted inside an opening 27, formed in the insulator 11 by means of spring-biased pivot pins 28, so that either of the delay devices are aligned between opposite ends of the electrodes. The delay devices may be spring biases, as shown, in order to insure electrical contacts there between and the electrodes. As shown in FIG. 11, accesses on diametrically opposite sides of the insulator permit rotation of the barrel between two fingers of a person's hand.

While various changes may be made in the detail construction, it is understood that such changes will be within the spirit and scope of the present invention, as is defined by the appended claims.

What I now claim is:

1. An improved dual internal electric spark plug, comprising, in combination, an insulator, a casing around said insulator, means for attaching said casing to an engine cylinder head, and a pair of electrodes through said insulator, one protruding end of said electrodes being designed for connection to electric wiring connectors, and opposite protruding ends comprising positive contacts respective to substantially "L" shaped anvil negative contacts formed on said casing, and each of said electrodes being interrupted by solid state H.V. time delay devices; a plurality of said time delay devices being circularly arranged and extending axially in a rotatable barrel inside said insulator, so that said time delay devices are selectively aligned between adjacent ends of each said electrode for preferred use.

2. The combination as set forth in claim 1, wherein said time delay devices are of different delay intervals.

3. The combination as set forth in claim 2, wherein said delay devices comprise a plurality of diodes arranged for either a negative or a positive system.

4. The combination as set forth in claim 3, wherein said diodes are arranged alike, so as to prevent a flash back across said electrodes.

* * * * *